US009044067B2

(12) United States Patent
Edington et al.

(10) Patent No.: US 9,044,067 B2
(45) Date of Patent: Jun. 2, 2015

(54) ARTICLE OF FOOTWEAR HAVING SHOCK-ABSORBING ELEMENTS IN THE SOLE

(75) Inventors: Christopher J. Edington, Portand, OR (US); Michael DiTullo, Cambridge, MA (US)

(73) Assignee: Converse Inc., North Andover, MD (US)

( * ) Notice: Subject to any disclaimer, the term of this patent is extended or adjusted under 35 U.S.C. 154(b) by 792 days.

(21) Appl. No.: 12/618,225

(22) Filed: Nov. 13, 2009

(65) Prior Publication Data

US 2010/0122471 A1 May 20, 2010

Related U.S. Application Data

(60) Provisional application No. 61/115,027, filed on Nov. 14, 2008.

(51) Int. Cl.

| | |
|---|---|
| ***A43B 13/18*** | (2006.01) |
| ***A43B 21/26*** | (2006.01) |
| *A43B 7/06* | (2006.01) |
| *A43B 7/14* | (2006.01) |

(52) U.S. Cl.

CPC . *A43B 21/26* (2013.01); *A43B 7/06* (2013.01); *A43B 7/148* (2013.01); *A43B 7/144* (2013.01); *A43B 13/181* (2013.01)

(58) Field of Classification Search

CPC ..... A43B 7/144; A43B 7/148; A43B 7/1485; A43B 7/06; A43B 13/18; A43B 13/181; A43B 13/12; A43B 13/186; A43B 21/132; A43B 21/126; A43B 13/188

USPC ..... 36/28, 29, 30 R, 103, 35 R, 25 R

See application file for complete search history.

(56) References Cited

U.S. PATENT DOCUMENTS

| | | | | | |
|---|---|---|---|---|---|
| 3,834,046 | A | * | 9/1974 | Fowler | 36/28 |
| 4,845,863 | A | | 7/1989 | Yung-Mao | |
| 4,864,737 | A | | 9/1989 | Marrello | |
| 4,887,367 | A | * | 12/1989 | Mackness et al. | 36/28 |
| 4,908,962 | A | | 3/1990 | Yung-Mao | |
| 4,972,611 | A | * | 11/1990 | Swartz et al. | 36/28 |
| 5,222,311 | A | | 6/1993 | Lin | |
| 5,255,451 | A | * | 10/1993 | Tong et al. | 36/30 A |
| 5,367,791 | A | * | 11/1994 | Gross et al. | 36/31 |
| 5,517,770 | A | | 5/1996 | Martin | |
| 5,619,809 | A | * | 4/1997 | Sessa | 36/3 R |
| 5,775,005 | A | | 7/1998 | McClelland | |
| 5,782,014 | A | * | 7/1998 | Peterson | 36/28 |
| 5,787,609 | A | | 8/1998 | Wu | |

(Continued)

*Primary Examiner* — Jila M Mohandesi

(74) *Attorney, Agent, or Firm* — Shook, Hardy & Bacon L.L.P.

(57) ABSTRACT

A shoe is provided having a sole that provides excellent shock absorption without reducing support and stability or such a shoe that is generally light in weight. The shoe may have a sole for supporting a foot of a wearer, and a shoe upper adjacent the sole. The sole may include an upper force-distribution plate portion, a lower force-distribution plate portion spaced below the upper plate portion, a lateral shell connecting the upper and lower force-distribution plate portions, and at least one resilient shock-absorber element in contact with and between both the upper and lower plate portions.

16 Claims, 11 Drawing Sheets

(56) References Cited

U.S. PATENT DOCUMENTS

| | | | | |
|---|---|---|---|---|
| 5,983,529 | A | 11/1999 | Serna | |
| 6,041,519 | A | 3/2000 | Cheng | |
| 6,041,521 | A | 3/2000 | Wong | |
| 7,152,343 | B2 | 12/2006 | Whatley | |
| 7,398,608 | B2 * | 7/2008 | Schoenborn | 36/28 |
| 7,757,411 | B2 * | 7/2010 | Nakano | 36/37 |
| 8,141,272 | B2 * | 3/2012 | Hay et al. | 36/25 R |
| 2007/0277401 | A1 | 12/2007 | Young-Chul | |

* cited by examiner

ARTICLE OF FOOTWEAR HAVING SHOCK-ABSORBING ELEMENTS IN THE SOLE

CROSS-REFERENCE TO RELATED APPLICATIONS

This application Claims Benefit To U.S. Provisional Patent Application No. 61/115,027, Filed Nov. 14, 2008, Entitled "Icon Type Midsole Member For Footwear."

FIELD OF THE INVENTION

The invention relates generally to impact-attenuation systems, e.g. for use in footwear and other foot-receiving devices, such as in the heel areas of footwear or foot-receiving device products, and particularly to athletic shoes having shock-absorbing soles for use with rigorous activities such as running or court sports.

TECHNICAL FIELD

The present invention relates to shoes. The present invention offers several practical applications in the technical arts, including but not limited to the use of shock-absorbing soles in shoes. More particularly, the present invention relates to the shock-absorbing characteristics of sole portions of shoes.

BACKGROUND OF THE INVENTION

Conventional articles of athletic footwear have included two primary elements, namely an upper member and a sole structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the ground. In addition to attenuating ground or other contact surface reaction forces, the sole structure may provide traction and control foot motions, such as pronation or suppination. Accordingly, the upper member and sole structure may operate cooperatively to provide a comfortable structure that is suited for a variety of ambulatory activities, such as walking, running or playing basketball.

A conventional athletic shoe includes an outsole, a midsole, and an upper. Such a shoe is typically designed to reduce the shock felt by the wearer during foot strike(s). Such reduction in shock may provide comfort and reduce the likelihood of injury to the wearer. Unstable shoes may cause short- or long-term injury due to the excessive motion at the joints brought on by unstable materials and designs.

Cushioning in most athletic shoes is supplied through a foam midsole made from ethylene vinyl acetate (EVA) or polyurethane (PU). These materials are relatively inexpensive, easily molded, and provide ample cushioning when they are new. Other shoes have used gas-filled and liquid-filled bladders to provide the required cushioning. Both of these shoe constructions provide adequate cushioning when they are new. Fluid-filled bladders continue to provide like-new cushioning for the life of the shoe, assuming that the fluid remains encapsulated in the shoe. In contrast, shoe midsoles made from foams provide adequate cushioning when they are new, but quickly lose some of their cushioning ability when the open cellular structure inside the foam suffer catastrophic failure from the application of vertical and/or shear forces.

EVA foams have compression (compaction) set rates of greater than 50%. This means that the ability to provide cushioning is reduced by at least 50% due to compaction of the cushioning material. In contrast to EVA, PU generally has better compression set. However, the use of PU increases the weight of the shoe compared to the use of EVA.

In addition to cushioning, a shoe should also supply support and stability. Generally, as the materials used under foot become softer, the support and stability decrease. Harder/firmer materials lend the most support and stability. Since harder/firmer materials decrease the amount of available cushioning, providing adequate cushioning without detracting from support and stability may be a challenge that requires attention to detail with respect to material choices and design.

BRIEF SUMMARY OF THE INVENTION

Aspects of this invention relate to impact-attenuation systems, e.g., for use in footwear and other foot-receiving devices, such as in the heel areas of footwear or foot-receiving device products, and/or to the provision of an improved shoe, such as a light-weight shoe having a sole that provides excellent shock absorption without reducing support and stability.

A shoe of the present invention may have a sole for supporting a foot of a wearer, and a shoe upper adjacent to the sole. The sole may comprise an upper force-distribution plate portion, a lower force-distribution plate portion spaced below the upper force-distribution plate portion, a lateral shell connecting the upper and lower force-distribution plate portions, and at least one resilient shock-absorber element in contact with and between both the upper and lower force-distribution plate portions.

In another aspect of the present invention, a shoe comprises a sole for supporting a foot of a wearer, and a shoe upper adjacent the sole. A sole may comprise an outsole portion spaced below the upper and a plurality of discrete, resilient, shock-absorber elements. Shock-absorber elements may be positioned between the outsole portion and the upper. Each shock-absorber element may be generally circular in shape in horizontal cross-section. In embodiments, a plurality of shock-absorber elements are aligned along a heel shank of the sole.

Other objects and features will be in part apparent and in part pointed out hereinafter.

BRIEF DESCRIPTION OF THE SEVERAL VIEWS OF THE DRAWING

A more complete understanding of the present invention and certain advantages thereof may be acquired by referring to the following description in consideration with the accompanying drawings, in which like reference numbers indicate like features.

DETAILED DESCRIPTION OF THE INVENTION

Figure 1:
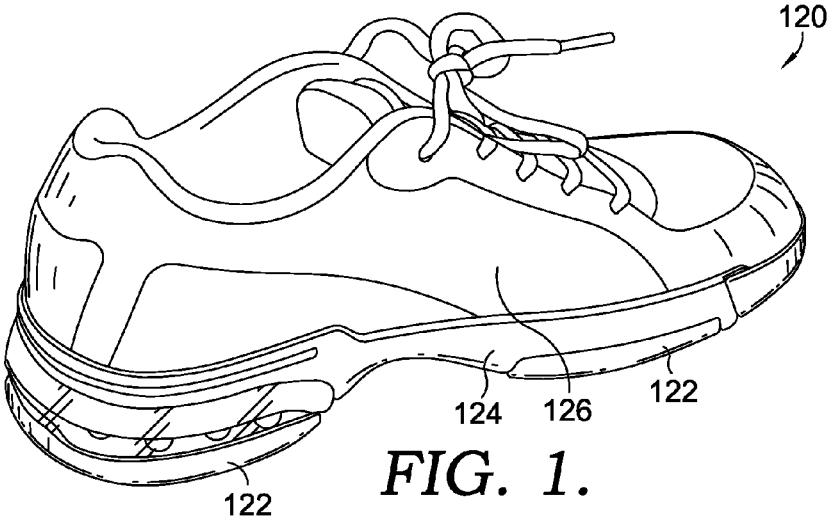
FIG. 1 illustrates a perspective of a medial side of an article of footwear in accordance with an embodiment of the present invention.

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "side," "front," "rear," "upper," "lower," "vertical," "horizontal," and the like may be used in this specification to describe various example features and elements of the invention, these terms are used herein as a matter of convenience, e.g., based on the example orientations shown in the figures, orientations at rest, and/or orientations during typical use. This specification should not be construed as requiring a specific three dimensional orientation of structures in order to fall within the scope of this invention.

To assist the reader, this specification is broken into various subsections, as follows: Terms; General Background Relating to the Invention; General Description of Impact-Attenuation or Shock-Absorbing Systems and Products Containing Them; Example Foot-Receiving Device Configurations; and Conclusion.

A. Terms

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, basketball shoes, tennis shoes, baseball cleats, soccer or football cleats, ski boots, etc.), and the like.

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Contact surface-contacting elements" or "members" include at least some portions of a foot-receiving device structure that contact the ground or any other surface in use, and/or at least some portions of a foot-receiving device structure that engage another element or structure in use. Such "contact surface-contacting elements" may include, for example, but are not limited to, outsole elements provided in some conventional footwear products. "Contact surface-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

B. General Background Relating to the Invention

In producing athletic footwear, manufacturers generally tend to restrict movement of a wearer of the footwear as little as possible. However, due to the different loads that arise on bones and muscles during ambulatory activities, footwear may also be designed to reduce fatigue and/or the risk of injuries under applied incident loads. One cause of injuries and/or premature fatigue of joints and/or muscles during exercise relates to the misorientation of the foot during a step cycle. During a normal step walking, the average person tends to first contact the ground with the heel and subsequently rolls-off off the heel using the ball of the foot.

Many people slightly turn their foot from the outside to the inside between the first ground contact with the heel and pushing-off with the ball of the foot. At ground contact, a person's center of mass typically is located more on the lateral side (the outside) of the foot, but it tends to shift to the medial side (the inside) during the course of the step cycle. This turning of the foot to the medial side is called "pronation." "Supination," on the other hand, constitutes a turning of the foot in the opposite direction during the course of a step. Supination and excessive pronation can lead to increased strain on the joints and premature fatigue or even injury. Therefore, manufacturers of shoes, and particularly athletic shoes, make efforts to control the degree of turning of the foot during a step cycle in order to avoid these misorientations.

There are a number of known ways of influencing pronation. For example, supporting elements often are placed in the midfoot and/or forefoot areas of a sole structure to help users avoid excessive turning of the foot to the medial and/or lateral sides, e.g., during push-off. Typically, the heel portion of such sole structures only serves to attenuate ground reaction forces. Such corrective measures, however, fail to recognize that the initial ground contact phase of a step cycle also influences the later course of motion of the foot during the step.

At least some aspects of the present invention relate to providing foot-supporting structures for articles of footwear and other foot-receiving device products that help provide improved and/or correct orientation of a foot starting from the first ground contact phase of a step cycle. Such improvements and/or corrections may help reduce and/or eliminate misorienations, premature fatigue, and/or wear of the joints and the muscles.

C. General Description of Impact-Attenuation or Shock-Absorbing Systems and Products Containing them In general, aspects of this invention relate to impact-attenuation or shock-absorbing members, products and systems in which they are used (such as footwear, other foot-receiving devices, heel cage elements, and the like), and methods for including them in such products and systems and using them in such products and systems. These and other aspects and features of the invention are described in more detail below.

1. Foot-Receiving Device Products Including Impact-Attenuation Members According to the Invention Foot-receiving device products, such as articles of footwear, in accordance with at least some example aspects of this invention, comprise: (a) a foot-covering member, such as an upper member for an article of footwear; and (b) a foot-supporting member (such as a sole structure) engaged with the foot-covering member. The foot-supporting member (e.g., sole structure) may include impact-attenuating or shock-absorbing members located in a heel portion of the foot-supporting member in various configurations. Impact-attenuating members may be provided in the sole structure in different configurations without departing from the invention. For example, in some structures according to the invention, an impact-attenuating member may be provided: (a) in the lateral heel portion of the sole structure in front of a softer and/or less impact force-resistant impact-attenuating member; (b) in the medial heel portion of the sole structure in front of a softer and/or less impact force-resistant impact-attenuating member; (c) in the rear, medial heel portion (e.g., along a side of a softer and/or less impact force-resistant impact-attenuating member); (d) along an arch portion; and/or (e) in a forefoot portion. In at least some example foot-receiving device structures in accordance with embodiments of the present invention, some or all of impact-attenuation member(s) of a shock-absorbing system may be included at locations and orientations so as to be at least partially visible from an exterior of an article of footwear. Alternatively, if desired, impact-attenuation member(s) may be hidden or at least partially hidden in the overall footwear or foot-receiving device product structure, such as within the foam material of a midsole element, within a gas-filled bladder member, etc. For example, impact-attenuation member(s) may be placed within a heel region, a forefoot region, and/or within a full region under the sole of a shoe.

Additional aspects of this invention relate to foot-supporting members and/or impact-attenuation systems, e.g., sole structures or portions thereof, such as a heel unit or the like, that include two or more impact-attenuating members, e.g., of the various types, constructions, orientations, and/or relative characteristics described above. If desired, the various impact-attenuating members may be engaged with a common base member, e.g., to provide a structure that is insertable as a unit into an article of footwear or other foot-receiving device constructions. Such members and/or systems may have relative orientation and/or impact-attenuating characteristics described above.

2. Methods of Making and Using Foot-Receiving Device Products According to the Invention Additional aspects of this invention relate to methods of making footwear or other foot-receiving device products including impact-attenuation members or shock-absorbing elements structured and/or arranged in accordance with examples of this invention and methods of using such impact-attenuation members and/or such products, e.g., for attenuating contact surface reaction forces. Such methods may include: (a) providing a foot-covering member, such as an upper member for an article of footwear (e.g., by making it in a conventional manner, obtaining it from another source, etc.); and (b) engaging a foot-supporting member (e.g., a sole structure) with a foot-covering member.

Once a shock-absorbing system and/or impact-attenuation member(s) have been incorporated in an article of footwear or other foot-receiving device product structure, the article of footwear or other product may be used in a known manner, and the impact-attenuation members may attenuate the ground reaction forces (e.g., as a result of landing a step or jump). In examples, an article of footwear may constitute an athletic and/or training shoe, e.g., used for running, walking, basketball, other ambulatory and/or athletic activities, etc.

D. Example Foot-Receiving Device Configurations

The various figures in this application illustrate examples of impact-attenuation members and/or shock-absorbing elements and shock-absorbing systems, as well as products and methods according to examples of this invention. When the same reference number appears in more than one drawing, that reference number may be used consistently in this specification and the drawings to refer to the same or similar parts throughout. In the description above and that which follows, various connections and/or engagements are set forth between elements in the overall structures. The reader may understand that these connections and/or engagements are general and, unless specified otherwise, may be direct or indirect and that this specification is not intended to be limiting in this respect.

FIG. 1 illustrates a perspective of a medial side of an article of footwear in accordance with an embodiment of the present invention. The article of footwear illustrated in FIG. 1 may be a shoe, such as shoe 120. Shoe 120 may be an athletic shoe (e.g., a running shoe, basketball shoe, tennis shoe, etc). Further, shoe 120 may comprise an outsole, generally indicated at 122; a midsole, generally indicated at 124; and an upper, generally indicated at 126. Outsole 122 and/or midsole 124 may be made from conventional outsole and midsole materials, such as carbon rubber. Additionally, midsole 124 may be made of a cushioning material, such as foam polyurethane or foam ethylene vinyl acetate. Further, upper 126 may be of leather or other conventional upper materials.

Figure 2:
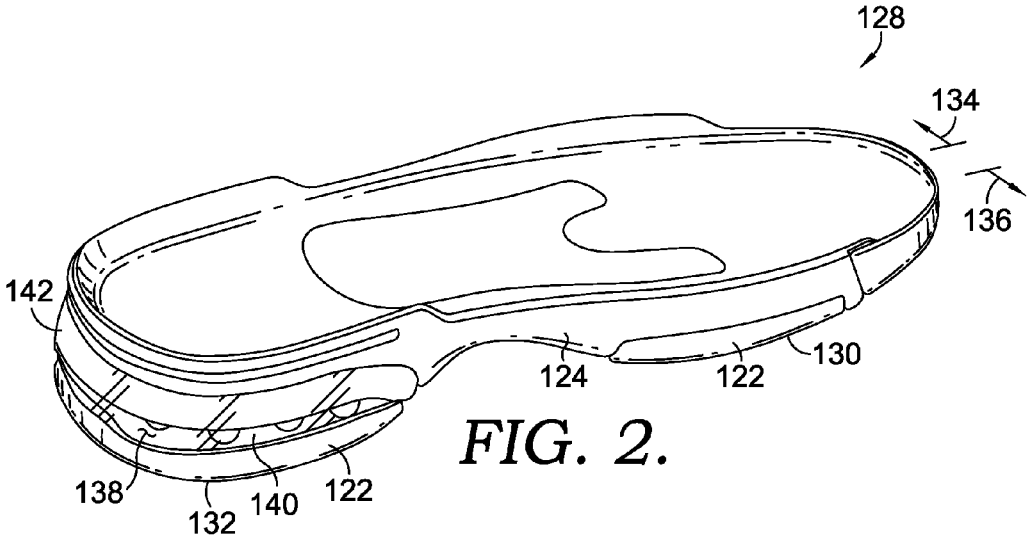
FIG. 2 illustrates a perspective of a medial side of a sole of an article of footwear in accordance with an embodiment of the present invention.
Figure 3:
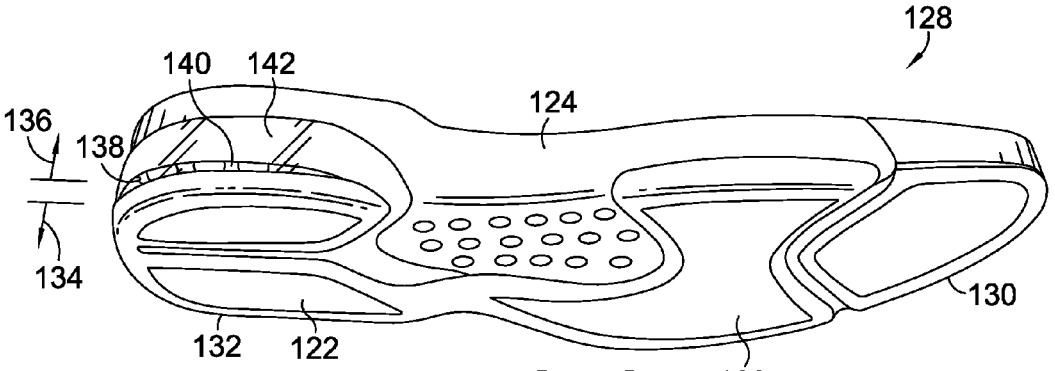
FIG. 3 illustrates a further perspective of a medial side of a sole of an article of footwear in accordance with an embodiment of the present invention.

FIGS. 2 and 3 each illustrate a perspective of a medial side of a sole 128 of an article of footwear, such as shoe 120, in accordance with an embodiment of the present invention. Sole 128 may comprise outsole 122, midsole 124, and lateral shell 142. Sole 128 may also comprise a forefoot region, generally indicated at 130; a heel region, generally indicated at 132; a lateral side, generally indicated at 134; and a medial side, generally indicated at 136. Forefoot region 130, heel region 132, lateral side 134 and medial side 136 may correspond to and/or be adjacent to like portions of a wearer's foot when the wearer wears shoe 120. Sole 128 may also comprise a cavity 138 formed within heel region 132. Sole 128 may retain at least a significant portion of a shock-absorbing support system 140.

Figure 4:
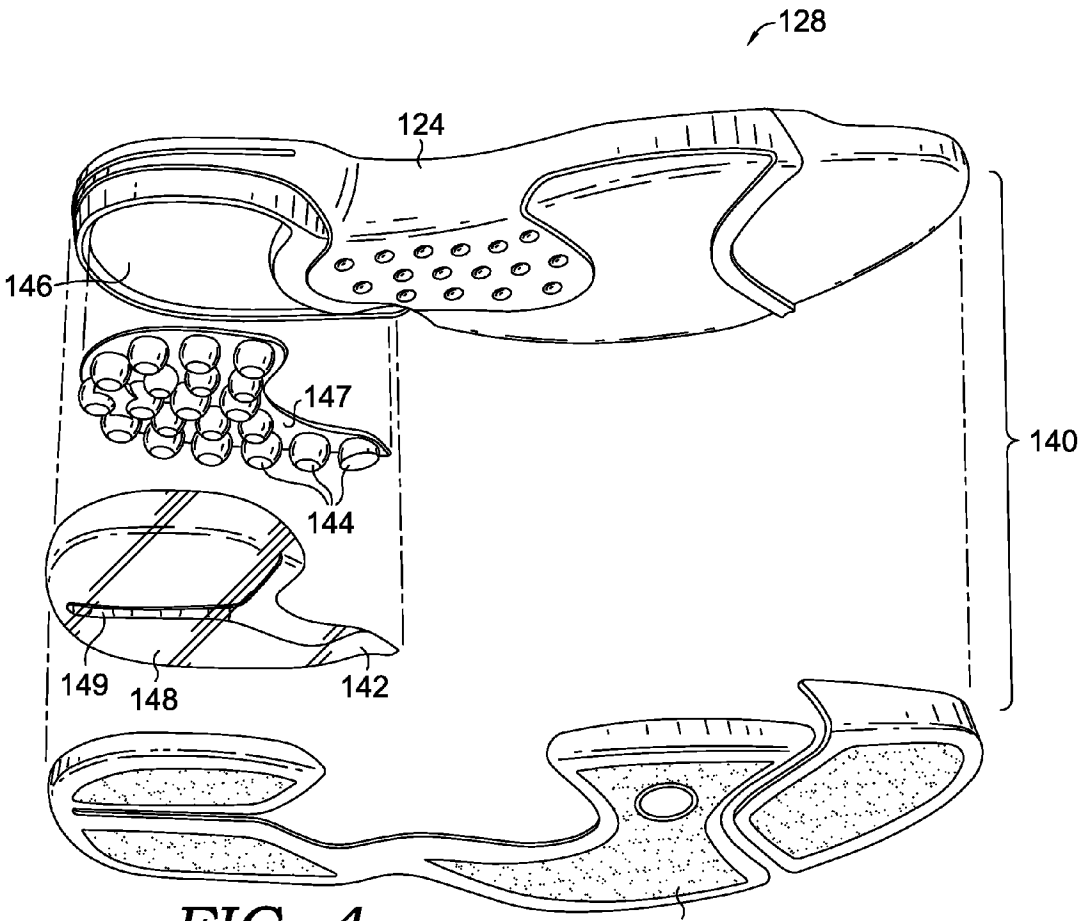
FIG. 4 illustrates an exploded view of a sole of an article of footwear comprising a shock-absorbing system in accordance with an embodiment of the present invention.

FIG. 4 illustrates an exploded view of a sole 128 of an article of footwear comprising a shock-absorbing system 140 in accordance with an embodiment of the present invention. Shock-absorbing support system 140 may comprise a lateral shell 142 connecting an upper force-distribution plate portion 146, a lower force-distribution plate portion 148 spaced below upper force-distribution plate portion 146, a plurality of rounded shock-absorber elements 144 extending between upper and lower force-distribution plate portions 146 and 148, respectively, a resilient integral plate portion 147, and a channel 149.

In embodiments, shock-absorber elements 144 may be connected to one or more resilient integral plate portion(s) 147 that connect the shock-absorber elements 144, or subgroups thereof, to form shock-absorber units. Shock-absorber elements 144 may be formed on resilient integral plate portion 147 as raised balls extending therefrom. For instance, shock-absorber elements 144 may be molded as an integral unit along with, and from the same material as, resilient integral plate portion 147. Resilient integral plate portion 147 may be in contact with upper force-distribution plate portion 146 and, further, may transfer forces therefrom to shock-absorber elements 144. In alternative embodiments, shock-absorber elements 144 may be directly connected to upper force-distribution plate portion 146.

Upper force-distribution plate portion 146 and/or lower force-distribution plate portion 148 may possess a characteristic of being semi-rigid. A semi-rigid characteristic may provide load distribution and stability to shock-absorbing support system 140. Shock-absorber elements 144 may be in contact with and extend between force-distribution plate portion(s) 146 and/or 148. Additionally, shock-absorber elements 144 may provide shock attenuation and cushioning. Further, lateral shell 142 may enhance support and stability of a system by providing a lateral structure that can generally encapsulate the system and/or assist with retaining its shape and orientation during use.

Force-distribution plate portion(s) 146 and/or 148 may form upper and lower perimeters, respectively, of shock-absorbing support system 140. Additionally, force-distribution plate portion(s) 146 and/or 148 may be sufficiently stiff to provide stability and to transfer the loading forces of a foot to shock-absorber elements 144. In embodiments, upper force-distribution plate portion 146 may be sufficiently stiff to prevent the user from feeling individual shock-absorber elements 144. In further embodiments, upper force-distribution plate portion 146 may be formed of relatively rigid material, such as nylon. Additionally and/or Alternatively, upper force-distribution plate portion 146 may be molded into or otherwise adhered to midsole 124. Additionally, upper force-distribution plate portion 146 may comprise a thin midsole and a lasted upper. In embodiments, shock-absorber elements may be aligned beneath a thin midsole adhered to an upper, where the thin midsole and upper may act as an upper force-distribution plate portion 146. In further embodiments, lower force-distribution plate portion 148 may comprise a lower portion of lateral shell 142.

Shock-absorber elements 144 may accept shock as transferred from force-distribution plate portion(s) 146 and/or 148. Further, shock-absorber elements 144 may deform as a load is applied. Further, shock-absorber elements 144 may provide resistance to an applied load. Additionally, shock-absorber elements 144 may return to their original shape when an applied load is removed. Further, shock-absorber elements 144 may have durometer hardness less than that of force-distribution plate portion(s) 146 and/or 148. In embodiments, a choice of material, hardness, geometry, placement and number of shock-absorber elements may affect a cushioning response of a heel shock-absorbing support system. Highly resilient, elastic, deformable materials that do not take a compression set may be desirable, such as thermoplastic urethane, thermoplastic rubber, polybutadiene, and peebax. Alternatively, shock-absorber elements 144 may comprise gas-filled or fluid-filled containers that provide a desired stiffness and/or resiliency. In further embodiments, shock-absorber elements 144 may be made of PU or EVA.

A rounded geometry of shock-absorber elements 144 may provide various advantages. For example, vertical and/or shear forces applied to shock-absorber elements 144 during use of an athletic shoe may often exceed several times a wearer's body weight. Therefore, the shape of shock-absorber elements, such as shock-absorber elements 144, may be desired to be conducive to resisting these forces. In embodiments, each shock-absorber element 144 may have a generally circular shape through its horizontal cross-section and/or may have a generally ellipsoidal shape. In further embodiments, each shock-absorber element 144 may be generally spherical in shape. Additionally and/or alternatively, a sphere and/or ball-shaped shock-absorber element 144 may effectively and resiliently respond to vertical and shear loading. Rounded and/or generally spherically-shaped shock-absorber elements 144 may generally not bend or kink when loaded. Rather, rounded and/or generally spherically-shaped shock-absorber elements 144 may generally deform under an applied load by flattening until the load is removed, at which time the shock-absorber elements 144 may return to their original shape.

In embodiments, lateral shell 142 is relatively rigid to provide support and stability to shock-absorbing system 140. In the configuration shown, lateral shell 142 is formed as a lateral wall extension of lower plate portion 148. However, lateral shell 142 may be formed independently and may be made from a different material. In embodiments, lateral shell 142 may wrap around the vertical periphery of heel region 132 and connect upper and lower force-distribution plate portions 146 and 148, respectively. As such, lateral shell 142 may generally encapsulate shock-absorber elements 144 and form a border along three sides of the shock-absorbing system 140. Accordingly, lateral shell 142 may provide a firm wall for retaining a desired configuration of a shock-absorbing system 140 during use. In alternative embodiments, an outsole made of a sufficient hardness and thickness may act as the force-distribution plate 148. Further, an outsole made of a sufficient hardness and thickness may wrap up to connect to the upper, acting a lateral shell. In embodiments, sufficient hardness may comprise a hardness that is harder than the hardness of shock-absorber elements used in embodiments of a shoe.

Lateral shell 142 may be made from various materials, such as a suitable polymeric material that may be injection- or compression-molded. Examples may comprise a high hardness thermoplastic urethane (TPU) and/or nylon. More expensive materials such as carbon fiber may also be used to reduce weight but are not necessary to achieve the required mechanical properties. Cost, thermal stability, hardness range, bending resistance and component bonding may all be considered for material selection. In embodiments, lateral shell 142 and the upper and lower force-distribution plate portions 146 and/or 148, respectively, may have a durometer hardness of at least 70 shore D in order to achieve the desired hardness to transfer the load to the shock-absorber elements 144 and retain the desired configuration of shock-absorbing system 140 during use. The hardness of the force-distribution plate portion(s) 146 and/or 148 may be varied to increase or decrease stability and to meet the requirements of the particular sport or activity.

Lateral shell 142 in the configuration shown is a generally C-shaped component and surrounds the heel region 132. However, in alternative configurations, lateral shell 142 may only partially surround heel region 132. Further, lateral shell 142 and lower force-distribution plate portion 148 may be transparent or translucent to permit viewing of shock-absorber elements 144 by a user through the side portions of a heel or through portions of an outsole, such as outsole 122.

Figure 5:
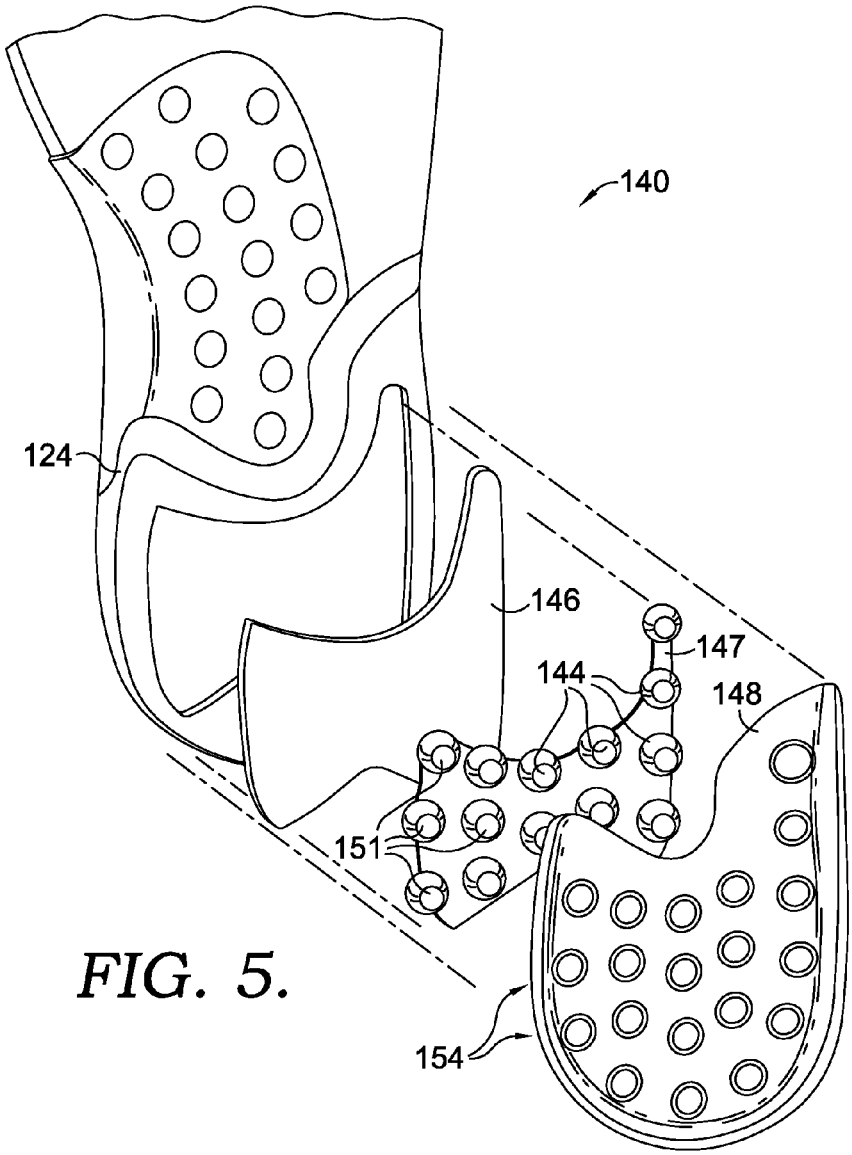
FIG. 5 illustrates an exploded view of a shock-absorbing system in accordance with an embodiment of the present invention.

FIG. 5 illustrates an exploded view of a shock-absorbing system 140 in accordance with an embodiment of the present invention. FIG. 5 comprises midsole 124, upper force-distribution plate portion 146, resilient integral plate portion 147, a plurality of shock-absorber elements 147, lower sides 151 of shock-absorber elements, sockets 154, and lower force-distribution plate portion 148. As illustrated in FIG. 5, in embodiments, a lower side 151 of at least some shock-absorber elements 144 may be received in opposing sockets 154 formed in lower force-distribution plate portion 148. In alternative embodiments, lower force-distribution plate portion 148 is devoid of opposing sockets, such as when lower force-distribution plate is smooth. In alternative embodiments where lower force-distribution plate portion 148 is devoid of sockets, shock-absorber elements may compress directly against lower force-distribution plate. By stabilizing at least some shock-absorber elements 144, sockets 154 may limit shifting of the shock-absorber elements 144 relative to the lower force-distribution plate portion 148. Lower sides 151 may also be flattened to improve their contact area with lower force-distribution plate portion 148. Additionally, shock-absorber elements 144 may be attached to lower force-distribution plate portion 148 via a chemical attachment, such as an adhesive or ultrasonic weld, a mechanical attachment, such as ball and socket attachment, and/or a combination of both.

Figure 6:
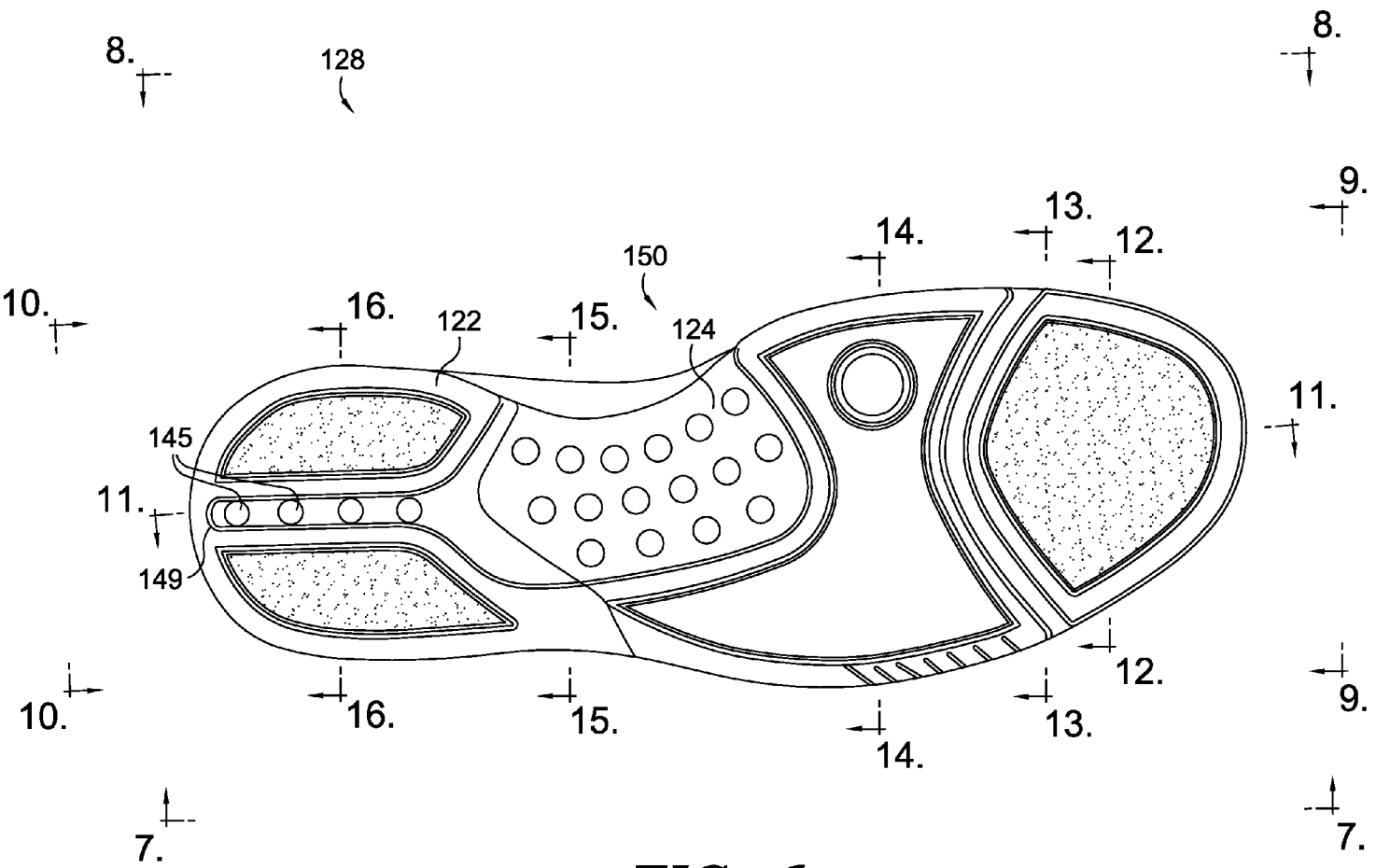
FIG. 6 illustrates a bottom view of a sole of an article of footwear in accordance with an embodiment of the present invention.

FIG. 6 illustrates a bottom view of a sole 128 of an article of footwear in accordance with an embodiment of the present invention. FIG. 6 comprises outsole 122, midsole 124, central shock-absorber elements 145, channel 149, and heel shank region 150. As shown in FIG. 6, one or more central shock-absorber elements 145 may be positioned generally in the center of a heel region to provide support directly below the heel. In the configuration shown, a plurality of central shock-absorber elements 145 are aligned along a longitudinal heel shank region 150 of sole 128. As provided in FIG. 6, outsole 122 comprises a channel 149 oriented along heel shank region 150. The combination of channel 149 and rounded or spherical central shock-absorber elements 145 may provide a flexible, yet robust, arrangement for providing resilient support to the user's heel during use in a wide variety of directions. Further, channel 149 may permit the heel region to flex along its heel shank region 150. The rounded or spherical central shock-absorber elements 145 may generally not limit flexing along heel shank region 150, but rather are able to bend or pivot vertically when the heel region flexes along heel shank region 150, while providing shock-absorbing benefits directly below the user's heel.

Figure 7:
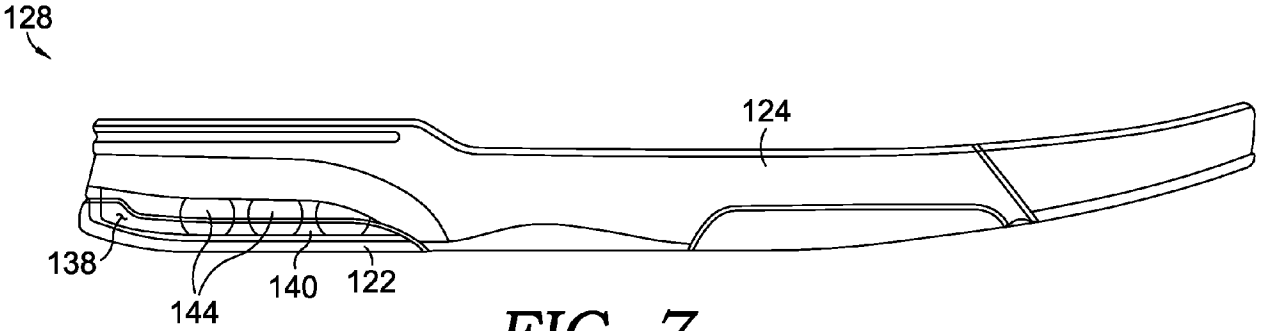
FIG. 7 illustrates a lateral side elevation view of a sole of an article of footwear as indicated in FIG. 6 in accordance with an embodiment of the present invention.
Figure 8:
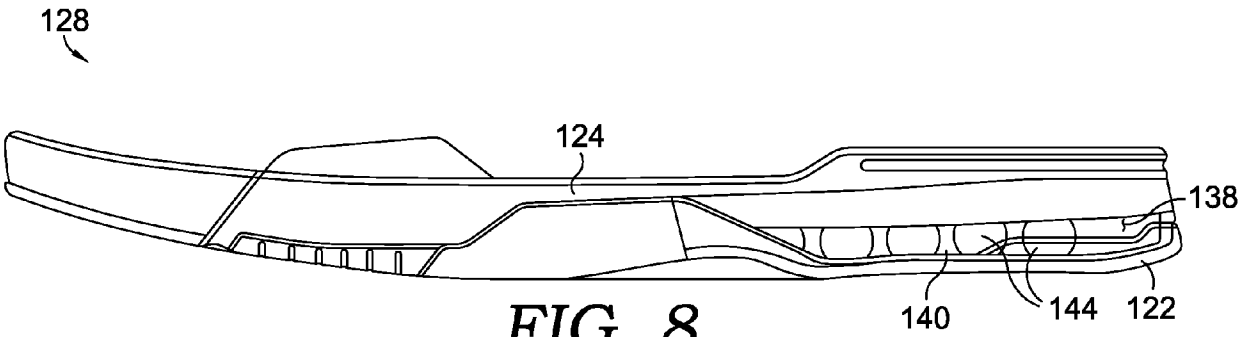
FIG. 8 illustrates a medial side elevation view of a sole of an article of footwear as indicated in FIG. 6 in accordance with an embodiment of the present invention.

FIGS. 7 and 8 illustrate side view of sole 128 as provided in FIG. 6. In particular, FIG. 7 illustrates a lateral side elevation view of a sole 128 of an article of footwear as indicated in FIG. 6 in accordance with an embodiment of the present invention. Further, FIG. 8 illustrates a medial side elevation view of a sole 128 of an article of footwear as indicated in FIG. 6 in accordance with an embodiment of the present invention. FIGS. 7 and 8 each comprise a sole 128, where sole 128 comprises an outsole 122, a midsole 124, a cavity 138, a shock-absorbing support system 140, and a plurality of rounded shock-absorber elements 144.

Figure 9:
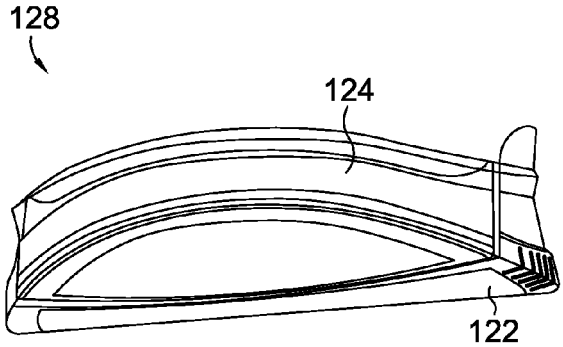
FIG. 9 illustrates a front elevation view of a sole of an article of footwear as indicated in FIG. 6 in accordance with an embodiment of the present invention.
Figure 10:
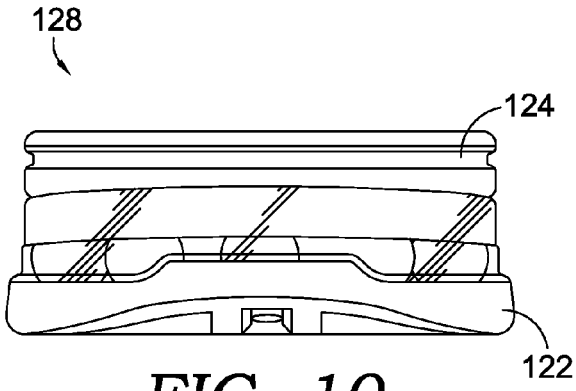
FIG. 10 illustrates a rear elevation view of a sole of an article of footwear as indicated in FIG. 6 in accordance with an embodiment of the present invention.

FIGS. 9 and 10 illustrate front and rear views of a sole 128 as provided in FIG. 6. In particular, FIG. 9 illustrates a front elevation view of a sole 128 of an article of footwear as indicated in FIG. 6 in accordance with an embodiment of the present invention. Further, FIG. 10 illustrates a rear elevation view of a sole 128 of an article of footwear as indicated in FIG. 6 in accordance with an embodiment of the present invention. FIGS. 9 and 10 each comprise a sole 128, where sole 128 comprises an outsole 122 and a midsole 124.

Figure 11:
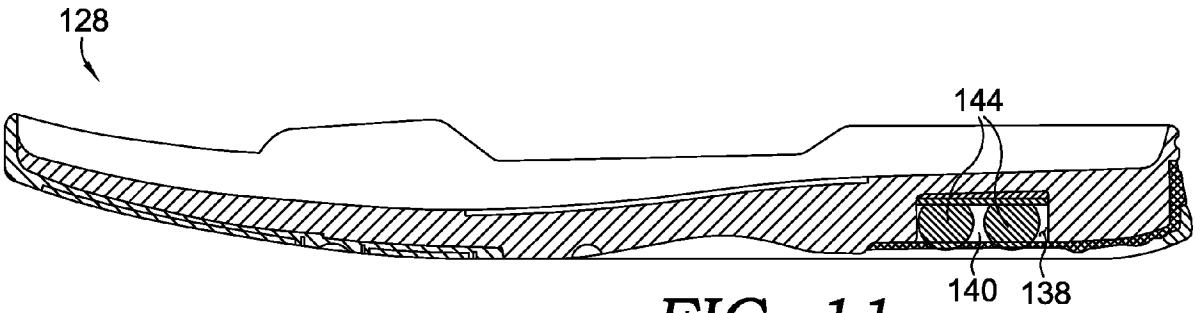
FIG. 11 illustrates a sectional view of a sole of an article of footwear taken along line 11-11 as indicated in FIG. 6 in accordance with an embodiment of the present invention.

FIGS. 11-16 illustrate sectional views of a sole 128 as provided in FIG. 6. In particular, FIG. 11 illustrates a sectional view of a sole 128 of an article of footwear taken along line 11-11 as indicated in FIG. 6 in accordance with an embodiment of the present invention. FIG. 11 comprises a sole 128, where sole 128 comprises a cavity 138, a shock-absorbing support system 140, and a plurality of rounded shock-absorber elements 144.

Figure 13:
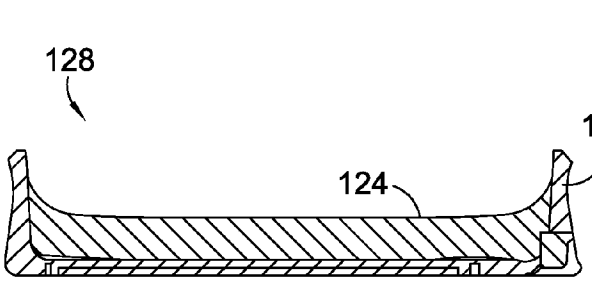
FIG. 13 illustrates a sectional view of a sole of an article of footwear taken along line 13-13 as indicated in FIG. 6 in accordance with an embodiment of the present invention.
Figure 12:
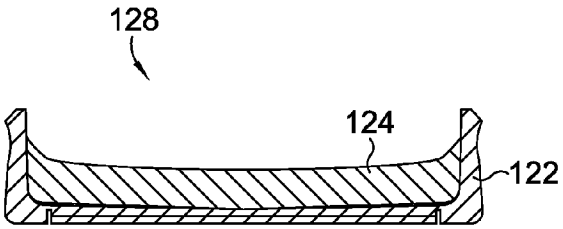
FIG. 12 illustrates a sectional view of a sole of an article of footwear taken along line 12-12 as indicated in FIG. 6 in accordance with an embodiment of the present invention.
Figure 14:
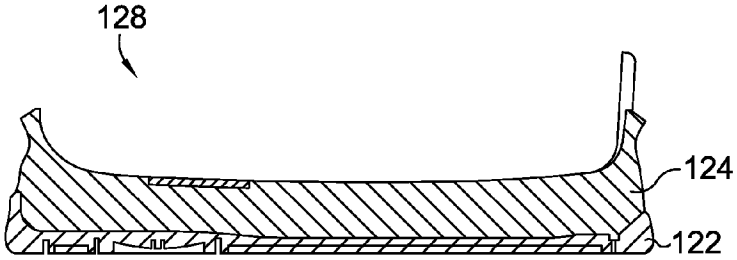
FIG. 14 illustrates a sectional view of a sole of an article of footwear taken along line 14-14 as indicated in FIG. 6 in accordance with an embodiment of the present invention.

FIGS. 12-14 illustrate sectional views of a sole 128 of an article of footwear taken along lines 12-12, 13-13, and 14-14 as indicated in FIG. 6 in accordance with embodiments of the present invention. FIGS. 12-14 each comprise a sole 128, where sole 128 comprises an outsole 122 and a midsole 124.

Figure 15:
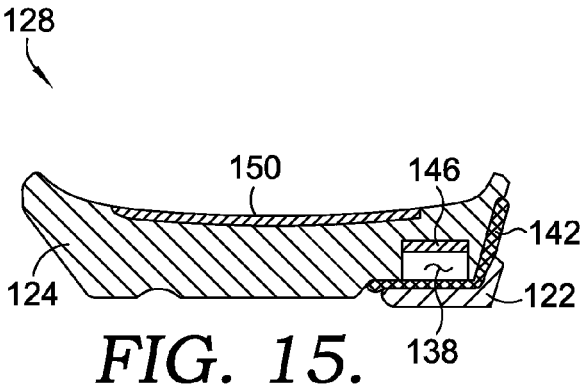
FIG. 15 illustrates a sectional view of a sole of an article of footwear taken along line 15-15 as indicated in FIG. 6 in accordance with an embodiment of the present invention.
Figure 16:
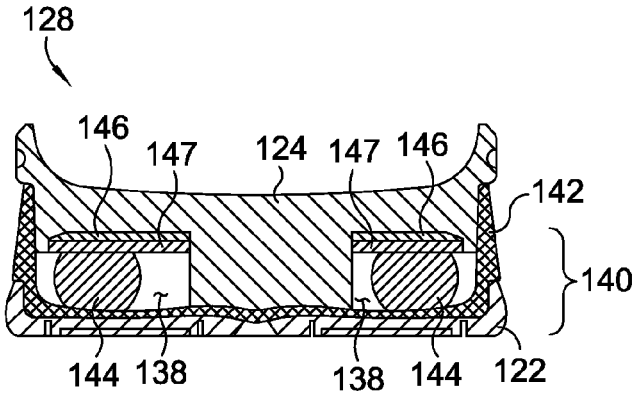
FIG. 16 illustrates a sectional view of a sole of an article of footwear taken along line 16-16 as indicated in FIG. 6 in accordance with an embodiment of the present invention.

FIG. 15 illustrates a sectional view of a sole 128 of an article of footwear taken along lines 15-15 as indicated in FIG. 6 in accordance with an embodiment of the present invention. FIG. 15 comprises a sole 128, where sole 128 comprises an a outsole 122, a midsole 124, a cavity 138, a lateral shell 142, an upper force-distribution plate 146, and a heel shank region 150. Further, FIG. 16 illustrates a sectional view of a sole 128 of an article of footwear taken along line 16-16 as indicated in FIG. 6 in accordance with an embodiment of the present invention. FIG. 16 comprises an a outsole 122, a midsole 124, a cavity 138, a lateral shell 142, a shock-absorbing support system 140, a plurality of rounded shock-absorber elements 144, an upper force-distribution plate 146, and a resilient integral plate portion 142.

Figure 17:
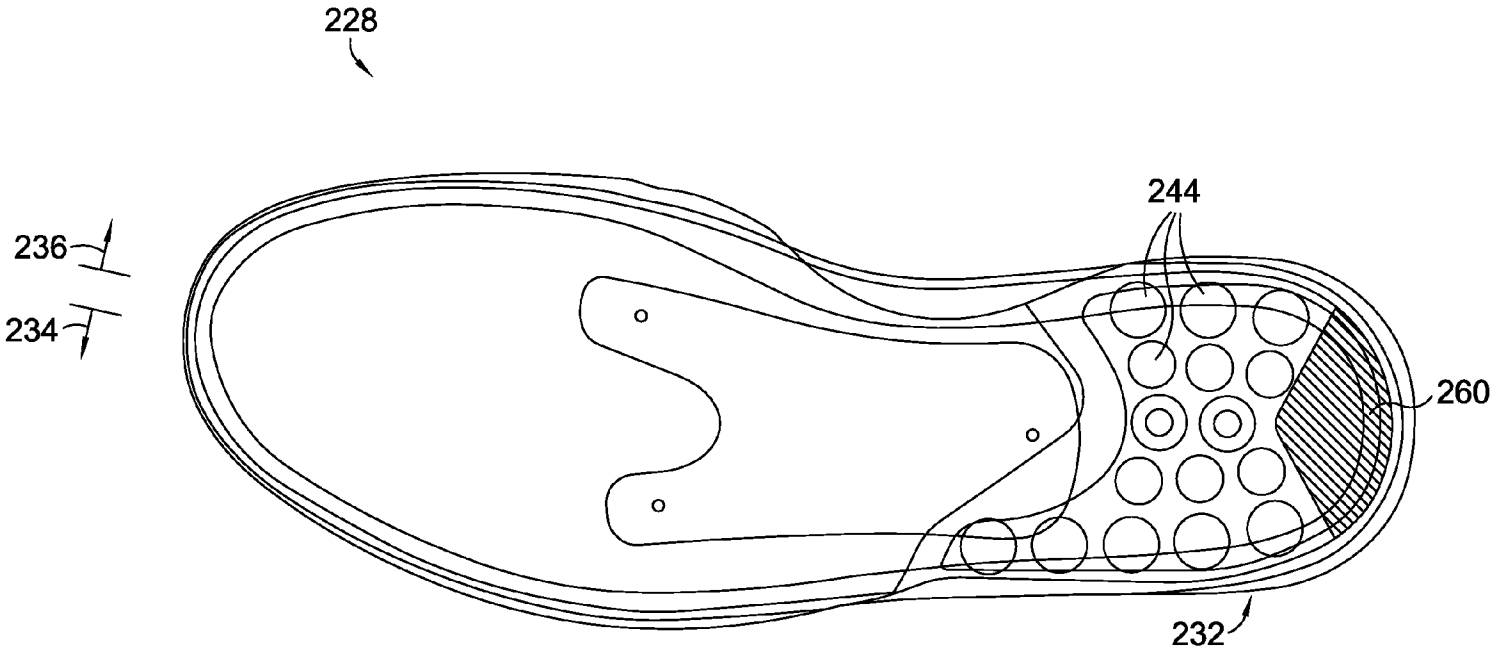
FIG. 17 illustrates a schematic top view of a sole of an article of footwear in accordance with an embodiment of the present invention.

FIG. 17 illustrates a schematic top view of a sole 228 of an article of footwear in accordance with an embodiment of the present invention. As shown in FIG. 17, shock-absorber elements 244 are preferably spaced from one another and positioned about the periphery of heel region 232 of sole 228 in a manner so that the unit provides medio-lateral support. FIG. 17 also comprises foam region 260. In the case of a running shoe, it may be desirable to make the medial side of the heel stiffer than the lateral side to reduce over-pronation of the heel. This may be accomplished by having shock-absorber elements 244, such as shock-absorber elements 244, adjacent medial side 236 being of a stiffer material (or geometry) than that of shock-absorber elements adjacent lateral side 234. Medial side 236 of the sole may also be made stiffer than the lateral side by having a greater number of shock-absorber elements 244 along medial side 136. Also as shown in FIG. 17, shock-absorber elements 244 may be positioned about the periphery of the heel region of sole 228 in an asymmetric pattern.

Further, the size and number of shock-absorber elements 244 may vary. For instance, shock-absorber elements 244 located along the periphery of the heel region 232 may have larger widths and/or diameters to provide greater resilience and shock-absorbing abilities along the perimeter, and the smaller shock-absorber elements 244 located in a central region can have smaller widths and/or diameters. Generally, shock-absorber elements 244 may have a diameter of about 10 to 23 mm. For example, shock-absorber elements 244 may range in diameter from about 12 to 20 mm depending on factors like type of shoe, shoe size, and location of the shock-absorber element 244 within a shoe, etc.

FIGS. 18-23 illustrate configurations of shock-absorber elements in accordance with embodiments of the present invention. For example, FIGS. 18 and 21 each comprise fewer shock-absorbing elements 344 and 444, respectively, than seen in FIG. 6 in heel region 132. The shock-absorber elements 344 and 444 in FIGS. 18 and 21, respectively, are spaced along the perimeter and rearward portions of heel regions 332 and 432, respectively. In contrast to FIG. 6, heel regions 332 and 432 comprise larger foam regions 360 and 460 at the rear portion of heel regions 332 and 432, respectively.

Figure 18:
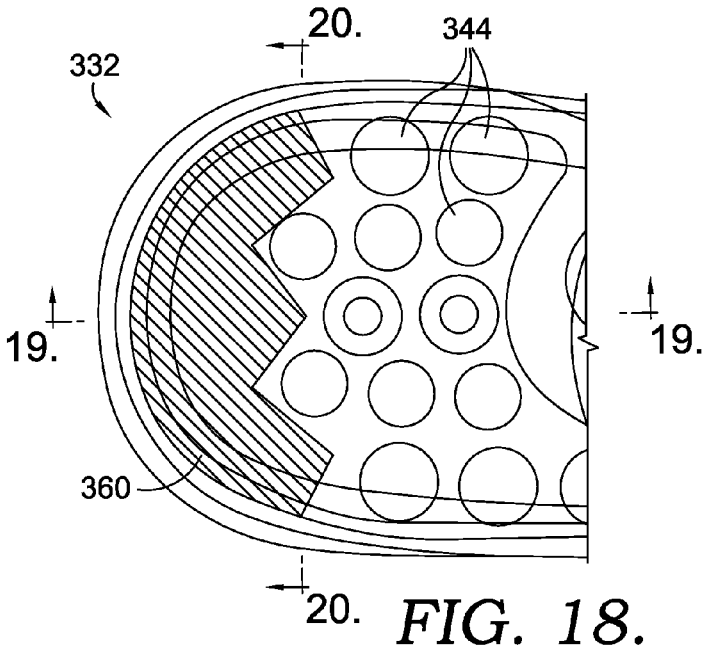
FIG. 18 illustrates a schematic top view of a first heel region of a sole of an article of footwear in accordance with an embodiment of the present invention.

In particular, FIG. 18 illustrates a schematic top view of a first heel region 332 of a sole of an article of footwear in accordance with an embodiment of the present invention. FIG. 18 comprises a first heel region 332, where first heel region 332 comprises a plurality of shock-absorber elements 344 and a first foam region 360.

Figure 19:
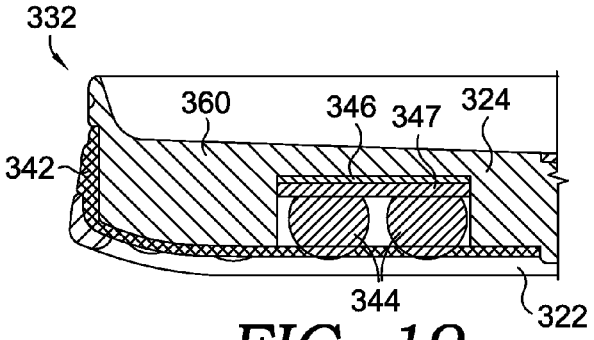
FIG. 19 illustrates a sectional view of a first heel region of a sole of an article of footwear taken along line 19-19 as indicated in FIG. 18 in accordance with an embodiment of the present invention.

FIG. 19 illustrates a sectional view of a first heel region 332 of a sole of an article of footwear taken along line 19-19 as indicated in FIG. 18 in accordance with an embodiment of the present invention. FIG. 19 comprises a first heel region 332, where first heel region 332 comprises outsole 322, lateral shell 342, a plurality of shock-absorber elements 344, an upper force-distribution plate 346, a resilient integral plate portion 347, a first foam region 360, and midsole 324.

Figure 20:
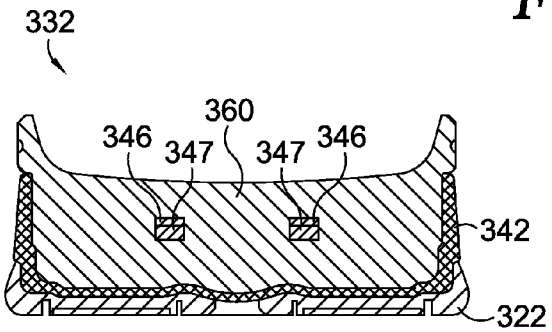
FIG. 20 illustrates a sectional view of a first heel region of a sole of an article of footwear taken along line 20-20 as indicated in FIG. 18 in accordance with an embodiment of the present invention.

FIG. 20 illustrates a sectional view of a first heel region 332 sole of an article of footwear taken along line 20-20 as indicated in FIG. 18 in accordance with an embodiment of the present invention. FIG. 20 comprises a first heel region 332, where first heel region 332 comprises outsole 322, lateral shell 342, an upper force-distribution plate 346, a resilient integral plate portion 347, and a first foam region 360.

Figure 21:
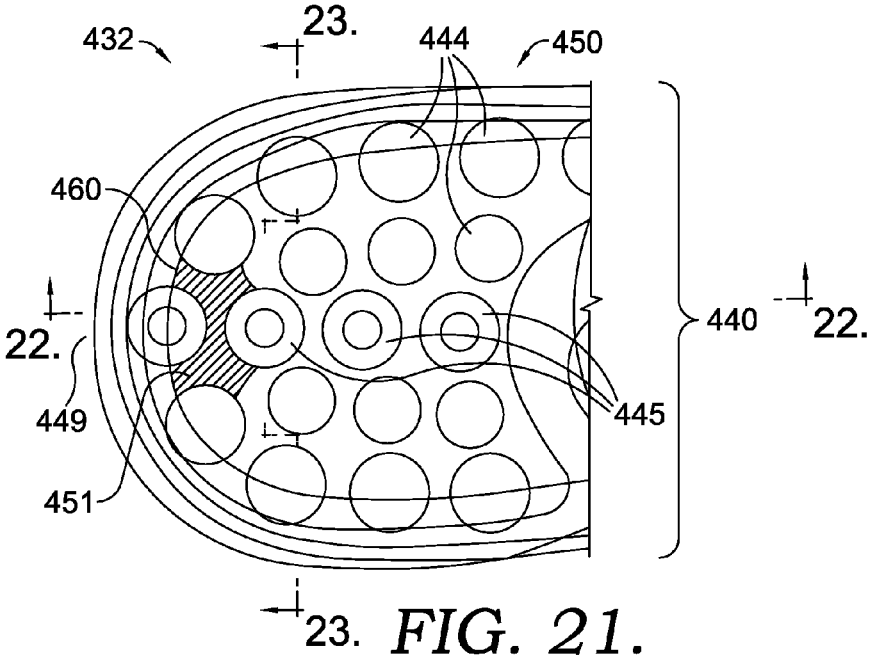
FIG. 21 illustrates a schematic top view of a second heel region of a sole of an article of footwear in accordance with an embodiment of the present invention.

FIG. 21 illustrates a schematic top view of a second heel region 432 of a sole of an article of footwear in accordance with an embodiment of the present invention. FIG. 21 comprises a second heel region 432, where second heel region 432 comprises a shock-absorbing system 440, a plurality of shock-absorber elements 444, and a second foam region 460. As such, FIG. 21 illustrates a shock-absorbing system configuration 440 that provides a high degree of shock-absorption and stability in second heel region 432. As provided in FIG. 21, a plurality of shock-absorber elements 444 comprises a portion of central shock-absorber elements 445. Central shock-absorber elements 445 are aligned in heel shank region 450. As shown, heel shank region 450 may comprise four central shock-absorber elements 445 aligned in heel shank region 450 along with central channel 449. Further, configuration 440 may comprise additional shock-absorber elements 444 at the rearmost portion of heel region 432. In addition, the rear-most shock-absorbing elements along the heel shank region 450 and at the rear of the heel region 432 may be connected via reinforcement arms 451, which provide a significant shock-absorbing configuration at the rearmost portion of the heel, as well as below the user's heel.

Figure 22:
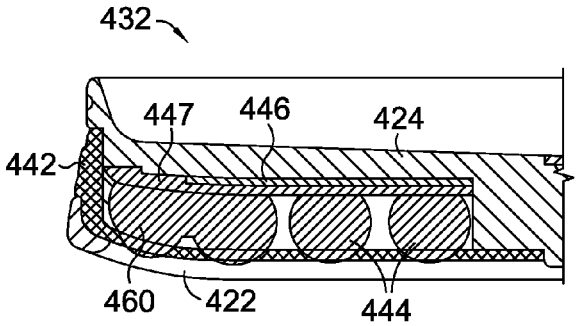
FIG. 22 illustrates a sectional view of a second heel region of a sole of an article of footwear taken along line 22-22 as indicated in FIG. 21 in accordance with an embodiment of the present invention.

FIG. 22 illustrates a sectional view of a second heel region 432 of a sole of an article of footwear taken along line 22-22 as indicated in FIG. 21 in accordance with an embodiment of the present invention. FIG. 22 comprises a second heel region 432, where second heel region 432 comprises outsole 422, lateral shell 442, a plurality of shock-absorber elements 444, a resilient integral plate portion 447, an upper force-distribution plate 446, a second foam region 460, and midsole 424.

Figure 23:
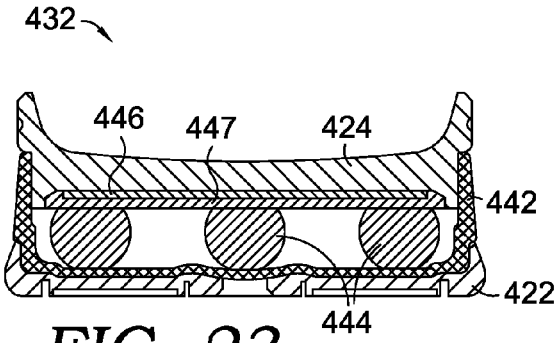
FIG. 23 illustrates a sectional view of a second heel region of a sole of an article of footwear taken along line 23-23 as indicated in FIG. 21 in accordance with an embodiment of the present invention.

FIG. 23 illustrates a sectional view of a second heel region 432 of a sole of an article of footwear taken along line 23-23 as indicated in FIG. 21 in accordance with an embodiment of the present invention. FIG. 22 comprises a second heel region 432, where second heel region 432 comprises an outsole 422, a lateral shell 442, a plurality of shock-absorber elements 444, an upper force-distribution plate 446, a resilient integral plate portion 447, and a midsole 424.

E. Conclusion

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and is within the scope of the claims.

What is claimed is:

1. A shock-absorbing system in a sole of a shoe, the system comprising:

a midsole portion forming a portion of a base of the shoe;

a plurality of substantially spherical shock-absorbing elements having a generally circular shape through a horizontal cross section, convex lateral sides through a vertical cross section and that is substantially parallel with the midsole portion, the plurality of substantially spherical shock-absorbing elements integrally formed with one or more resilient integral plates, the plurality of substantially spherical shock-absorbing elements aligned along and beneath the midsole portion, each of the shock-absorbing elements having an upper side proximate the midsole portion and an opposite lower side;

a force-distribution plate beneath the plurality of shock-absorbing elements, wherein the force-distribution plate is comprised of a plurality of sockets aligned with and positioned to anchor at least a portion of the plurality of shock-absorbing elements, each of the plurality of shock-absorbing elements permanently attached at the lower side to a corresponding socket of the plurality of sockets of the force-distribution plate; and a lateral shell encompassing the plurality of substantially spherical shock-absorbing elements, wherein the lateral shell includes a durometer hardness of at least 70 shore D to provide support and stability to the shock-absorbing system and wherein the lateral shell integral with at least a portion of the force-distribution plate.

2. The shock-absorbing system of claim 1, further comprising:

an outsole adjacent to the force-distribution plate, wherein the outsole forms a portion of the base of the shoe.

3. The shock-absorbing system of claim 2, wherein the force-distribution plate comprises a first channel aligned with the row of sockets.

4. The shock-absorbing system of claim 3, further comprising:

the outsole adjacent to the force-distribution plate, wherein the outsole comprises a second channel aligned with the first channel of the force-distribution plate.

5. The shock-absorbing system of claim 4, wherein the first channel of the force-distribution plate interlocks with the second channel of the outsole.

6. The shock-absorbing system of claim 1, wherein the force-distribution plate comprises a portion of an outsole.

7. A shock-absorbing system for use in a shoe, the system comprising:

an upper force-distribution plate having a first durometer hardness;

a lower force-distribution plate spaced below the upper force-distribution plate having a second durometer hardness, the lower force-distribution plate comprised of a plurality of sockets;

a plurality of resilient substantially spherical shock-absorber elements having convex lateral sides through a vertical cross section and a generally circular shape through a horizontal cross section that is substantially parallel with a midsole portion, the plurality of resilient substantially spherical shock-absorbing elements are integrally formed with one or more resilient integral plates, the plurality of resilient substantially spherical shock-absorbing elements are in contact with and between the upper force-distribution plate and lower force-distribution plate, a shock-absorber element of the plurality of shock absorber elements is aligned with and attached to a socket of the plurality of sockets, wherein the shock-absorber element having a third durometer hardness that is less than the first durometer hardness and the second durometer hardness.

8. The shock-absorbing system of claim 7, wherein the plurality of sockets are configured to position the shock-absorber elements.

9. The shock-absorbing system of claim 7, wherein the shock-absorber elements are generally flat-bottomed proximate the lower force-distribution plate.

10. The shock-absorbing system of claim 7, wherein the shock-absorber elements are continuously connected to the upper force-distribution plate.

11. The shock-absorbing system of claim 7, wherein at least one of the shock-absorber elements possesses a different durometer hardness than at least another of the shock-absorber elements.

12. The shock-absorbing system of claim 11, wherein the durometer hardness characteristic of shock-absorber elements varies laterally across the distribution of shock-absorber elements.

13. The shock-absorbing system of claim 7, further comprising:

a lateral shell encompassing the shock-absorber elements.

14. The shock-absorbing system of claim 13, wherein the lateral shell is part of the lower force-distribution plate.

15. The shock-absorbing system of claim 13, wherein the lateral shell is generally transparent.

16. The shock-absorbing system of claim 7, wherein the shock-absorbing system may be placed in at least one of a heel region, a forefoot region, and a sole region.

* * * * *